United States Patent [19]

Savarimuthu

[11] 4,085,710

[45] Apr. 25, 1978

[54] HYDRAULIC ENGINE PISTON

[76] Inventor: Sundar Savarimuthu, 17 Gleneagle Crescent, Willowdale, Ontario, Canada

[21] Appl. No.: 711,404

[22] Filed: Aug. 3, 1976

[51] Int. Cl.[2] ..... F02B 71/00; F15B 21/00

[52] U.S. Cl. ..... 123/19; 60/632; 91/5; 123/46 SC

[58] Field of Search ..... 123/19, 46 SC; 60/533, 60/632, 634; 91/5

[56] References Cited

U.S. PATENT DOCUMENTS

| | | | |
|---|---|---|---|
| 2,991,773 | 7/1961 | Cadiou | 123/46 SC |
| 3,886,745 | 6/1975 | Kaida et al. | 60/632 |

FOREIGN PATENT DOCUMENTS

| | | | |
|---|---|---|---|
| 556,675 | 2/1957 | Italy | 123/19 |
| 345,667 | 3/1931 | United Kingdom | 129/19 |

*Primary Examiner*—Charles J. Myhre
*Assistant Examiner*—Craig R. Feinberg
*Attorney, Agent, or Firm*—Robert D. Farkas

[57] ABSTRACT

A two piston hydraulic fluid separated internal combustion cylinder system utilizing a cylinder having fuel inlet ports, ignition means, a viewing window, a filling plug; a first piston, hydraulic fluid cushion and a smaller piston which may be connected to a crankshaft.

1 Claim, 2 Drawing Figures

HYDRAULIC ENGINE PISTON

BACKGROUND OF THE INVENTION

1. Field of the Invention

This invention relates to internal combustion engines and, in particular, to cylinders employing hydraulic fluid as a force transfer medium.

2. Prior Art

Internal combustion engines have been used for almost a century. Several inventions have been disclosed employing hydraulic fluid as a force transfer medium including Wallis in U.S. Pat. No. 3,905,339; Eickmann in U.S. Pat. No. 3,269,321 and Conrad in U.S. Pat. No. 3,066,426. All of these references disclose a pair of pistons having different diameters, whereby the smaller piston diameter impels hydraulic fluid to move through pipelines. The present invention employs hydraulic fluid between the larger and smaller pistons, multiplying the stroke of the smaller piston.

SUMMARY OF THE INVENTION

It is therefore an object of this invention to overcome the limitations and disadvantages in the internal combustion cylinders in the prior art and currently available in the market.

One of the objects of the invention is to provide an internal combustion cylinder embodying improved principles of design and construction.

An important object of the invention is to provide an internal combustion cylinder which is comprised of a number of simple durable parts or components which can be economically manufactured and readily assembled.

A significant object of the invention is to provide a cylinder system so designed and constructed that it can be readily installed in almost any typical internal combustion engine now in use.

Another object of the invention is to provide a pressure intensification system.

A further object of the invention is to reduce the mass of the moving system.

Yet another object of the invention is to provide high sustained output force over a longer time period.

A still further object of the invention is to simplify the construction of the moving parts.

A two piston hydraulic fluid separated internal combustion engine system, according to the principles of this invention, comprises a cylinder having fuel inlet ports, ignition means, a viewing window, a filling plug; a first piston, hydraulic fluid cushion and a smaller piston which may be connected to a crankshaft.

Further objects and advantages of this invention will appear more clearly from the following description of a non-limiting illustrative embodiment and the accompanying drawings in which like numerals designate like parts throughout the several views.

BRIEF DESCRIPTION OF THE DRAWING

Briefly summarized, a preferred embodiment of the invention is described in conjunction with an illustrative disclosure thereof in the accompanying drawings, in which.

DETAILED DESCRIPTION OF THE PREFERRED EMBODIMENT

Figure 1:
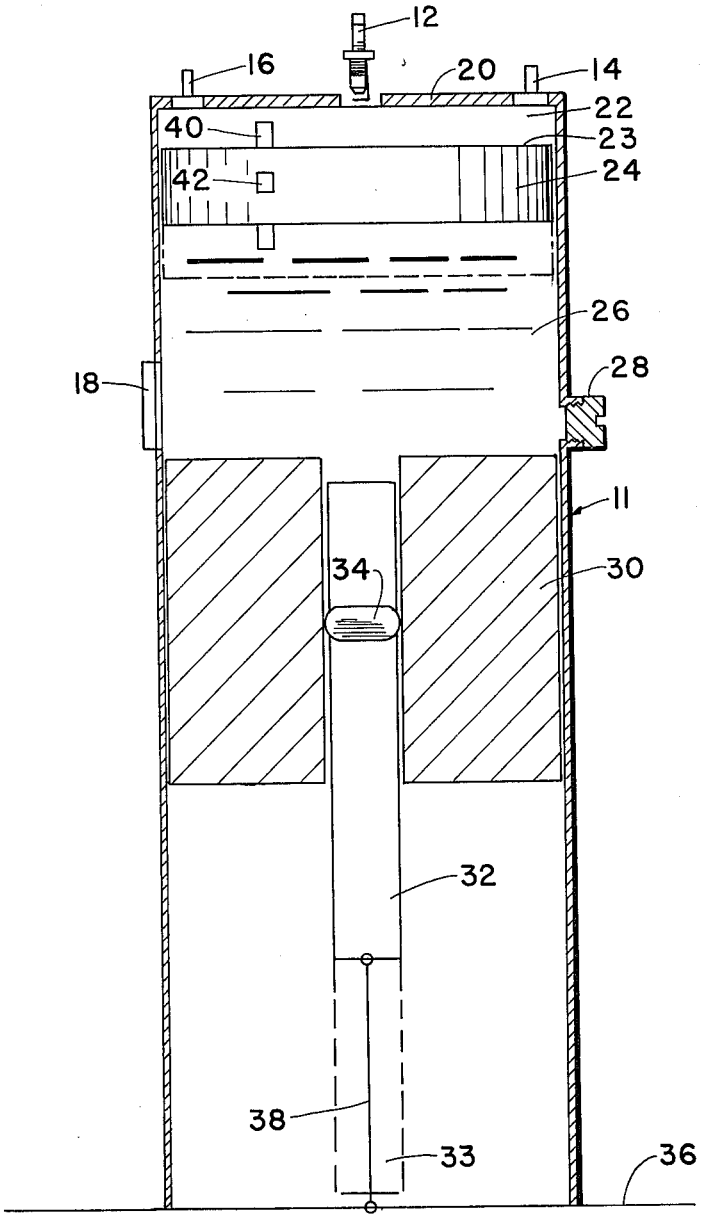
FIG. 1 is a cross sectional representation of the internal combustion cylinder system according to the principles of this invention.
Figure 2:
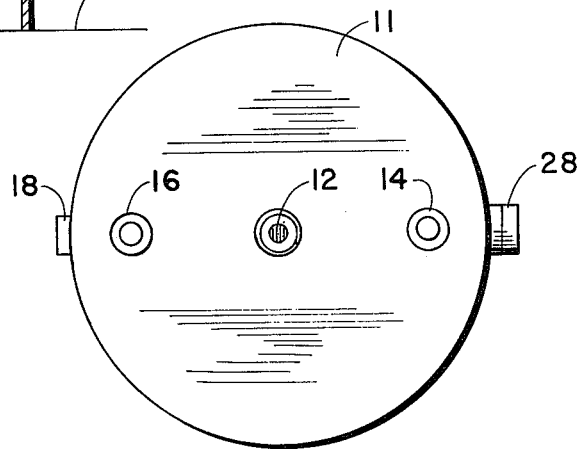
FIG. 2 is a top end view of the cylinder system.

In the drawings an internal combustion cylinder 11 embodying features of the invention is illustrated provided with inlet 16 and exhaust 14 ports, ignition means 12, a head 20, an oil level observation window 18, and a removable plug 28 for adding hydraulic fluid 26.

A large piston 24 is fitted to cylinder 11 and may employ rings or other known seals to effect an improved seal to separate the combusion chamber 22 from the hydraulic fluid 26. Piston 24 may be hollow to reduce mass and may have its head shaped to improve fuel mixing and combustion. Large piston 24 is separated by hydraulic fluid 26 from small piston 32 which may be suitably guided in block 30 which may be affixed to or an integral part of cylinder 11. Oil seal rings 34 may be provided around piston 32 to preclude masses of oil escaping past the piston. A fluid reservoir may be connected to the general fluid space to make up fluid.

The distant end of piston 32 may be connected to a crankshaft 36 as by a link 38 to convert the linear motion of piston 32 due to an explosion of a combustible mixture in chamber 22 into a rotary shaft motion.

Recognizing the current advanced state of the art in internal combustion engines, the combustion chamber, ports, ignition, head, cylinder end, and piston head may be suitably arranged for optimum combustion performance.

To preclude cocking of the large piston, paroxial grooves 40 in the walls of cylinder 11 engage mating protrusions 42 from the piston.

The advantages of this system include: short combustion chamber, short piston stroke, low mass of moving parts, long stroke of small diameter piston — all of which contribute to better performance at higher speeds.

Of course, several such cylinders systems may be combined into an engine which may employ a single phased multiple throw crankshaft.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

I claim:

1. A two piston hydraulic fluid separated internal combustion cylinder system having fuel admission means, comprising a first piston, a second piston, said second piston having a smaller diameter than said first piston, said first piston and said second piston being co-axially aligned, said first piston and said second piston being housed in a common cylinder, a first cavity located in said cylinder, said first piston being housed slidably in said first cavity, said fuel admission means coupled to said first cavity, a first side of said first piston being disposed opposite said fuel admission means, a second cavity, said second cavity being disposed in said cylinder, a second piston being disposed slidably mounted in said second cavity, the second side of said first piston being disposed facing said second cavity, a first side of said second piston being disposed facing said second side of said first piston, hydraulic oil, said hydraulic oil being disposed filling said second cavity, the second side of said second piston being disposed coupling a crank shaft, a plug, said plug being disposed in said first cavity, a viewing window, said viewing window being disposed in a wall of said window at a location in said second cavity, guiding means for guiding said first piston within said first cavity, a cylindrical block, said cylindrical block being disposed located in said cylinder and having an opening therein, said opening for guiding said second piston therein, said means to guide said first piston including a groove extending along a portion of the length of said wall of said cylinder in said first cavity, said first piston having a mating protrusion extending outwardly therefrom, said mating protrusion being disposed engaging said groove.

* * * * *